US009469473B2

(12) United States Patent
Thiessen

(10) Patent No.: US 9,469,473 B2
(45) Date of Patent: Oct. 18, 2016

(54) HOPPER BOTTOM FOR STORAGE BIN WITH INTEGRAL AERATION

(71) Applicant: Lester James Thiessen, Neilburg (CA)

(72) Inventor: Lester James Thiessen, Neilburg (CA)

(73) Assignee: ENVIRO PRODUCTION SYSTEMS INC., Neilburg, Saskatchewan (CA)

( * ) Notice: Subject to any disclaimer, the term of this patent is extended or adjusted under 35 U.S.C. 154(b) by 646 days.

(21) Appl. No.: 13/645,902

(22) Filed: Oct. 5, 2012

(65) Prior Publication Data

US 2013/0295833 A1 Nov. 7, 2013

Related U.S. Application Data

(60) Provisional application No. 61/643,459, filed on May 7, 2012.

(51) Int. Cl.
*B65D 88/28* (2006.01)
*B65D 88/74* (2006.01)

(52) U.S. Cl.
CPC ..... *B65D 88/745* (2013.01); *B65D 88/28* (2013.01); *B65D 88/742* (2013.01)

(58) Field of Classification Search
CPC .... B65D 88/26; B65D 88/74; B65D 88/742; B65D 88/745; B65D 88/28; F26B 17/12; F26B 1/22; F26B 2200/06
USPC ..... 454/173–183; 34/166, 174, 175, 179, 34/181, 233; 52/302.1
See application file for complete search history.

(56) References Cited

U.S. PATENT DOCUMENTS

| | | | | |
|---|---|---|---|---|
| 3,265,443 | A * | 8/1966 | Simas | B65D 88/30 406/175 |
| 4,009,520 | A * | 3/1977 | Sukup | F26B 9/103 34/233 |
| 4,520,714 | A * | 6/1985 | Gullickson | B65D 88/742 34/232 |
| 5,604,994 | A | 2/1997 | Annen et al. | |
| 7,818,894 | B2 * | 10/2010 | Noyes | F26B 9/103 34/169 |
| 2011/0014020 | A1 * | 1/2011 | Thiessen | B65G 65/46 414/326 |

FOREIGN PATENT DOCUMENTS

| | | |
|---|---|---|
| CA | 2008299 | 7/1991 |
| CA | 2698403 | 1/2011 |

* cited by examiner

*Primary Examiner* — Steven B McAllister
*Assistant Examiner* — Reginald McNeill, II
(74) *Attorney, Agent, or Firm* — Ryan W. Dupuis; Kyle R. Satterthwaite; Ade & Company Inc

(57) ABSTRACT

A hopper bottom for a grain bin includes a hopper wall having an inverted cone shape so as to taper downwardly and inwardly towards a central bottom opening and including ventilation openings therein. Perforated ducts extend into the grain bin from the ventilation openings. According to one embodiment upright support legs support the hopper wall above the foundation. Each upright support leg has a hollow interior chamber to direct air from an inlet manifold structure to the ventilation openings in the hopper wall. According to another embodiment, an outer support wall supports the hopper wall above a floor structure which collectively enclose a manifold space which directs air from a blower into the ventilation openings in the hopper wall.

12 Claims, 3 Drawing Sheets

HOPPER BOTTOM FOR STORAGE BIN WITH INTEGRAL AERATION

This application claims the benefit under 35 U.S.C. 119(e) of U.S. provisional application Ser. No. 61/643,459, filed May 7, 2012.

FIELD OF THE INVENTION

The present invention relates to a hopper bottom for supporting a storage bin thereon, for example a grain storage bin having a cylindrical side wall, and more particularly the present invention relates to a hopper bottom comprising an inner wall having an inverted cone shape which tapers downwardly and inwardly from a surrounding cylindrical outer wall support to a floor structure spanning below the outer wall support.

BACKGROUND

Particulate material storage bins are commonly used on farms for storing the grain. In some instances it is desirable for the grain bin to comprise a hopper bottom which is generally conical so as to taper downwardly and inwardly to the center to assist in center unloading of the grain bin. Such hopper bottoms may be formed integrally with the grain bin or may be formed as a separate component upon which a commercially available cylindrical bin is then supported.

Canadian patent application 2,008,299 by Weninger discloses an example of a grain bin hopper bottom in which the tapering cone portion terminates at a central bottom end spaced above the ground to receive an auger inlet therebelow. No means are provided for aeration through the hopper bottom.

Another known hopper bottom is disclosed in Canadian Patent Application 2,698,403 by Thiessen comprises a conical hopper portion which is surrounded by a cylindrical outer wall which supports the cone and the cylindrical bin walls thereabove. Ventilation of the grain in this hopper bottom is made available by enclosing the spaced between the hopper portion and the cylindrical outer wall to form a manifold which then directs air through perforated sections in the conical wall of the hopper portion. The manifold structure requires the use of the cylindrical outer wall. No means are provided for directing ventilation air into other parts of the grain bin other than through the perforated sections in the conical wall.

Further examples of grain drying through a hopper cone are disclosed in U.S. Pat. Nos. 5,604,994 by Annen et al. and 4,520,714 by Gullickson. In the prior art examples considerable ducting or multiple blowers are required to communicate ventilation air to the various perforated sections in the hopper cone.

SUMMARY OF THE INVENTION

According to one aspect of the invention there is provided a hopper bottom for supporting a cylindrical side wall of a grain bin above a foundation, the hopper bottom comprising:

a hopper wall having an inverted cone shape so as to taper downwardly and inwardly from a peripheral edge at a top end of the hopper wall to a central opening at a bottom end of the hopper wall, the peripheral edge being arranged to support the cylindrical side wall of the grain bin thereabove;

a plurality of upright support members supporting the hopper wall above foundation, each upright support member spanning between a bottom end arranged to be supported on the foundation and a top end adjacent the peripheral edge of the hopper wall, and each upright support member comprising a hollow interior chamber;

a plurality of ventilation openings in the hopper wall in communication with the hollow interior chambers of respective ones of the upright support members;

a manifold structure communicating between the hollow interior chambers of the upright support members; and an inlet opening in the manifold structure arranged for communication with a blower so as to be arranged to direct ventilation air from the blower and into the grain bin through the manifold structure, the upright support members and the ventilation openings.

The use of hollow support members in communication with ventilation openings in the hopper wall permits the support members to provide the dual function of: i) structural support for the hopper wall and grain bin thereon; and ii) a communication of ventilation air for aeration from a common manifold to a plurality of distributed locations about the base of the grain bin.

Preferably the support members comprise upright legs supported at circumferentially spaced locations about the peripheral edge of the hopper wall.

Preferably each upright leg comprises a tubular member defining the respective hollow interior chamber therein.

Preferably the manifold structure comprises a hollow tubular footing member extending in a circumferential direction below the peripheral edge of the hopper wall such that each upright support member communicates between the footing member and the respective ventilation opening in the hopper wall.

In some instances a screen member spans each of the ventilation openings in which the screen member is substantially flush with an upper surface of the inner wall.

Alternatively, the hopper bottom may include a plurality of perforated ducts in communication with respective ones of the ventilation openings in which the perforated ducts extend inwardly into the grain bin, for example upwardly along the side wall of the grain bin or downwardly along the hopper wall.

According to a second aspect of the present invention there is provided a hopper bottom for supporting a cylindrical side wall of a grain bin thereon, the hopper bottom comprising:

a floor structure spanning radially outwardly from a central area to a surrounding perimeter area;

an outer support wall extending upwardly from the perimeter area of the floor structure about the central area of the floor structure to a top end spaced upwardly from the floor structure and arranged to support the cylindrical side wall of the grain bin thereabove;

an inner hopper wall having an inverted cone shape so as to taper downwardly and inwardly from a top end to a bottom end of the inner hopper wall, the top end of the inner hopper wall being joined with the outer support wall at a location spaced above the floor structure about a full circumference of the outer support wall, and the bottom end of the inner hopper wall being supported in proximity to the floor structure about the central area of the floor structure;

a plurality of ventilation openings formed in the inner hopper wall;

a plurality of perforated ducts arranged to extend into the grain bin, the perforated ducts being in communication with the ventilation openings in the inner hopper wall respectively; and an inlet opening in the outer support wail arranged for communication with a blower;

the outer support wall comprising a continuous cylindrical wall joined to the floor structure about a full circumference of the floor structure so as to define an enclosed manifold space surrounding the inner hopper wall such that ventilation air forced into the enclosed manifold space through the inlet opening is arranged to be directed upwardly through the ventilation openings in the inner wall and into the perforated ducts.

The plurality of perforated ducts may be arranged to: i) extend upwardly from the respective ventilation openings alongside the cylindrical side wall of the grain bin; ii) extend downwardly and inwardly from the respective ventilation openings along the hopper wall towards the central opening; or iii) any combination thereof.

The ventilation openings in the hopper wall may be used in combination with an upright perforated exhaust duct suspended centrally in the grain bin.

Various embodiments of a hopper bottom for a grain storage bin with integral aeration will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
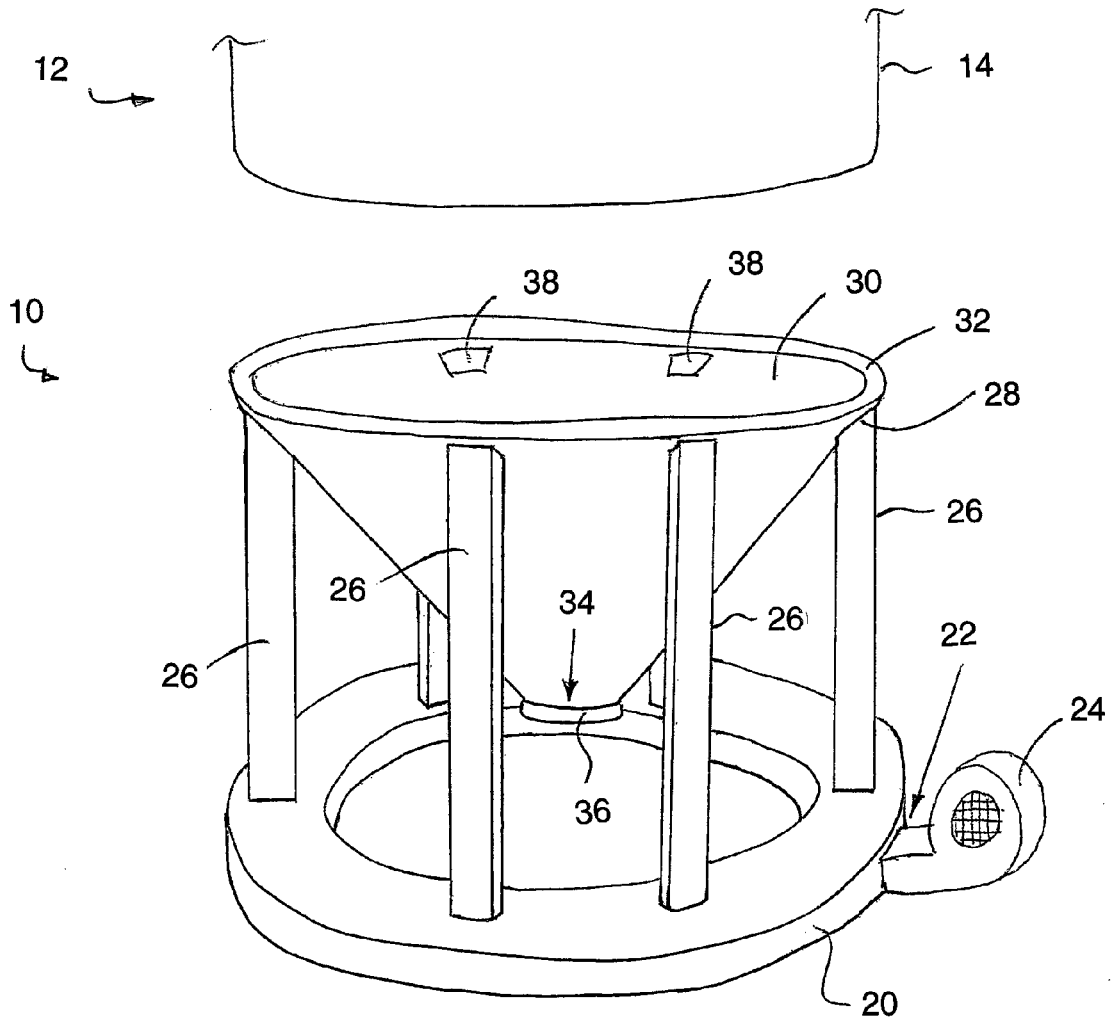
FIG. 1 is perspective view of a first embodiment of the grain bin hopper bottom.

Referring to the accompanying figures, there is illustrated a grain storage bin hopper bottom generally indicated by reference numeral 10.

The hopper bottom 10 is particularly suited for a bin 12 of the type comprising a cylindrical side wall 14 extending vertically upward and enclosed at the top end by a top wall 16. The top wall 16 is typically conical in shape so as to taper upwardly and inwardly to a central opening enclosed by a lid 18 at the top end.

Figure 2:
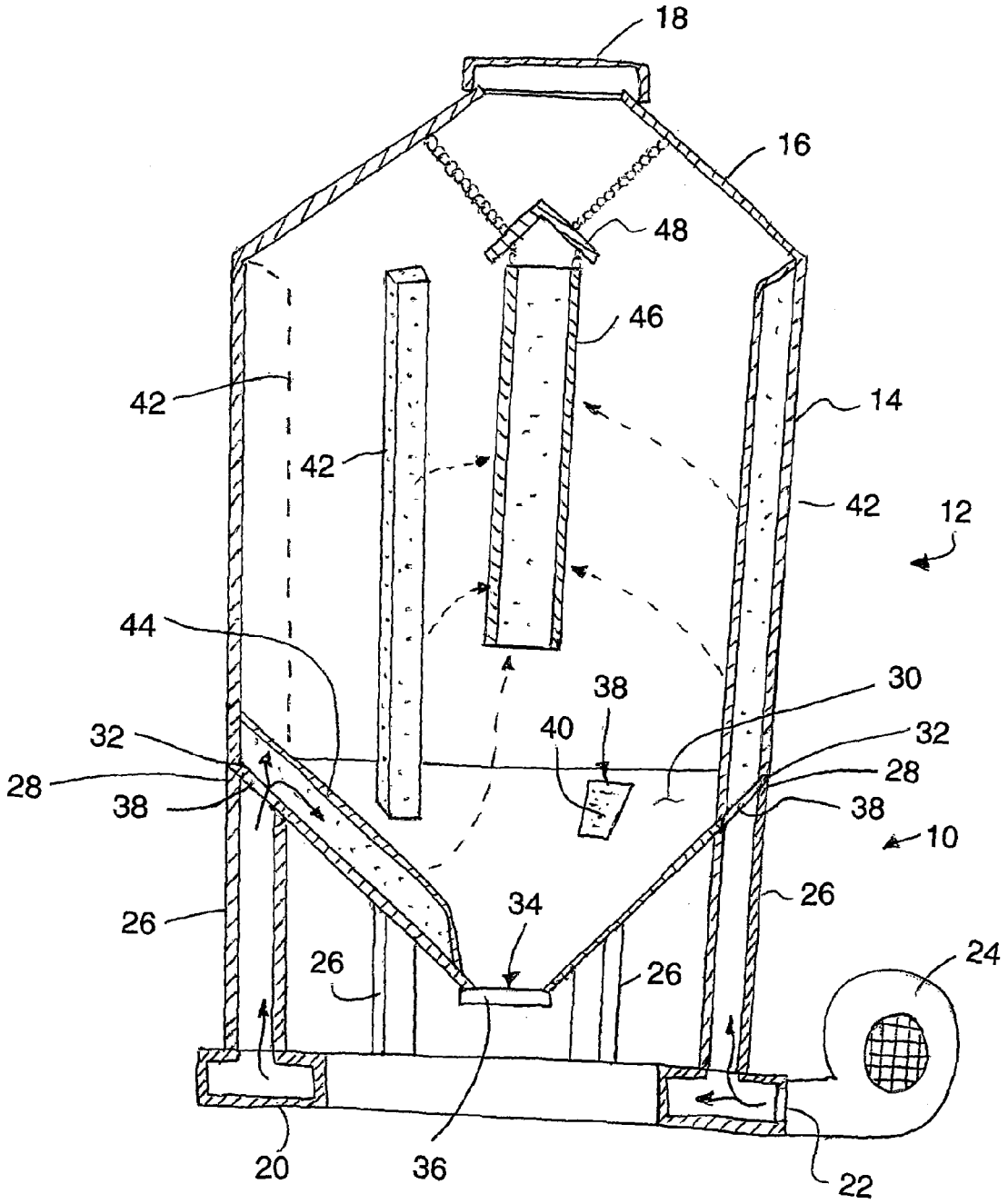
FIG. 2 is a sectional elevational view of the grain bin hopper bottom according to FIG. 1.

According to a first embodiment of FIGS. 1 and 2, the hopper bottom 10 includes an annular footing member 20 which is arranged to be supported on the ground or on a suitable foundation so as to lie in a generally horizontal plane with a diameter which corresponds approximately to the diameter of the grain bin to be supported thereon. The footing member is a hollow tubular member having an inlet opening 22 located in a side wall thereof for connection to a suitable blower 24. The hollow interior of the footing member defines a manifold structure which is arranged to distribute air from the blower 24 in a circumferential direction about the footing member from the inlet opening 22.

The hopper bottom further includes a plurality of upright support members 26 in the form of tubular legs mounted on the annular footing member to extend vertically upward therefrom at a plurality of circumferentially spaced positions. As shown in the accompanying Figures, the support members support the hopper wall and the grain bin thereon on the footing member which in turn supports the hopper wall, the grain bin and the support legs on the foundation. Each support member 26 defines a hollow interior chamber therein which communicates vertically from the interior manifold structure of the footing member therebelow to an open top end 28 spaced above the footing member.

A hopper wall 30 is supported on the support members 26 which takes the shape of an inverted cone. The hopper wall thus extends at downward and inward incline from a peripheral edge 32 at a top end to a central opening 34 at a bottom end. A suitable gate member 36 is mounted across the central opening for selectively enclosing the opening. The peripheral edge corresponds approximately in diameter to the diameter of the grain bin such that the cylindrical side wall of the grain bin is arranged to be supported directly on or above the top peripheral edge of the hopper wall which is in turn supported on the upper ends of the upright support members 26 at circumferentially spaced positions thereabout. Height of the upright support members 26 is arranged such that the central opening 34 at the bottom end of the hopper wall is suspended at a location spaced above the footing member by sufficient space to receive the inlet end of a transfer conveyor therebelow.

A plurality of ventilation openings 38 are located within the hopper wall 30 at circumferentially spaced positions in proximity to the peripheral edge 32 such that each ventilation opening is arranged for alignment with a respective one of the top ends 28 of the upright support members 26. The ventilation openings may communicate with the interior of the grain bin by various methods as disclosed in the following.

In some instances, a screen member 40 is mounted across the ventilation opening 38 so as to be substantially flush with an inner surface of the hopper wall. The screen member comprises a flat panel of perforated material permitting air flow from the blower to pass upwardly therethrough while having sufficiently small openings in the screen to prevent passage of grain or other particulate material stored in the bin such that the particulate material can only be discharged through the central opening 34.

In further configurations, an upright duct 42 may be associated with each ventilation opening 38 in which the duct comprises a U-shaped channel of perforated material joined to the side wall of the grain bin to form an enclosed passage which extends upwardly along the side wall from the respective ventilation opening 38. The duct in this instance extends upwardly into the grain bin from the ventilation opening to permit ventilation air from the blower to be discharged through the perforations in the duct at various elevations along the height of the side wall of the grain bin. Again, the perforation size is arranged such that blower air can be conveyed radially inwardly from the upright duct into the grain bin through the perforations but particulate material in the grain bin is prevented from entering the duct.

In further arrangements, an inclined duct 44 comprises a channel of perforated material joined to the hopper wall to define an enclosed passage which extends at a downward and inward incline from the respective ventilation opening towards the central opening 34 at the bottom of the hopper wall. The ventilation openings thus each communicate between a respective one of the inclined ducts at a top end of the inclined duct at an interior of the hopper wall, through the hopper wall to a respective one of the hollow interiors of the upright legs at an exterior of the hopper wall. The hollow interiors of all of the legs in turn communicate with the common manifold structure also externally of the hopper wall. The perforations are again sized to allow only blower air to pass therethrough. The ends of the duct are enclosed also by perforated material to permit blower air to be discharged into the grain bin at various positions along the duct while restricting particulate material from entering the duct.

Air is exhausted from the grain bin using an exhaust duct 46 in the form of an elongate tube of perforated material which is suspended at a central location within the grain bin to span a majority of the height of the bin. Typically, a cap 48 is provided at the top end of the duct to prevent particulate material from entering into the duct, The perforations along the duct permit blower air communicated into the grain bin to be discharged at various elevations into the duct before being subsequently exhausted upwardly through the top end of the grain bin by a suitable ventilated lid for example. Suitable chains or tethers may be used to suspend the exhaust duct from the top wall of the grain bin.

Figure 3:
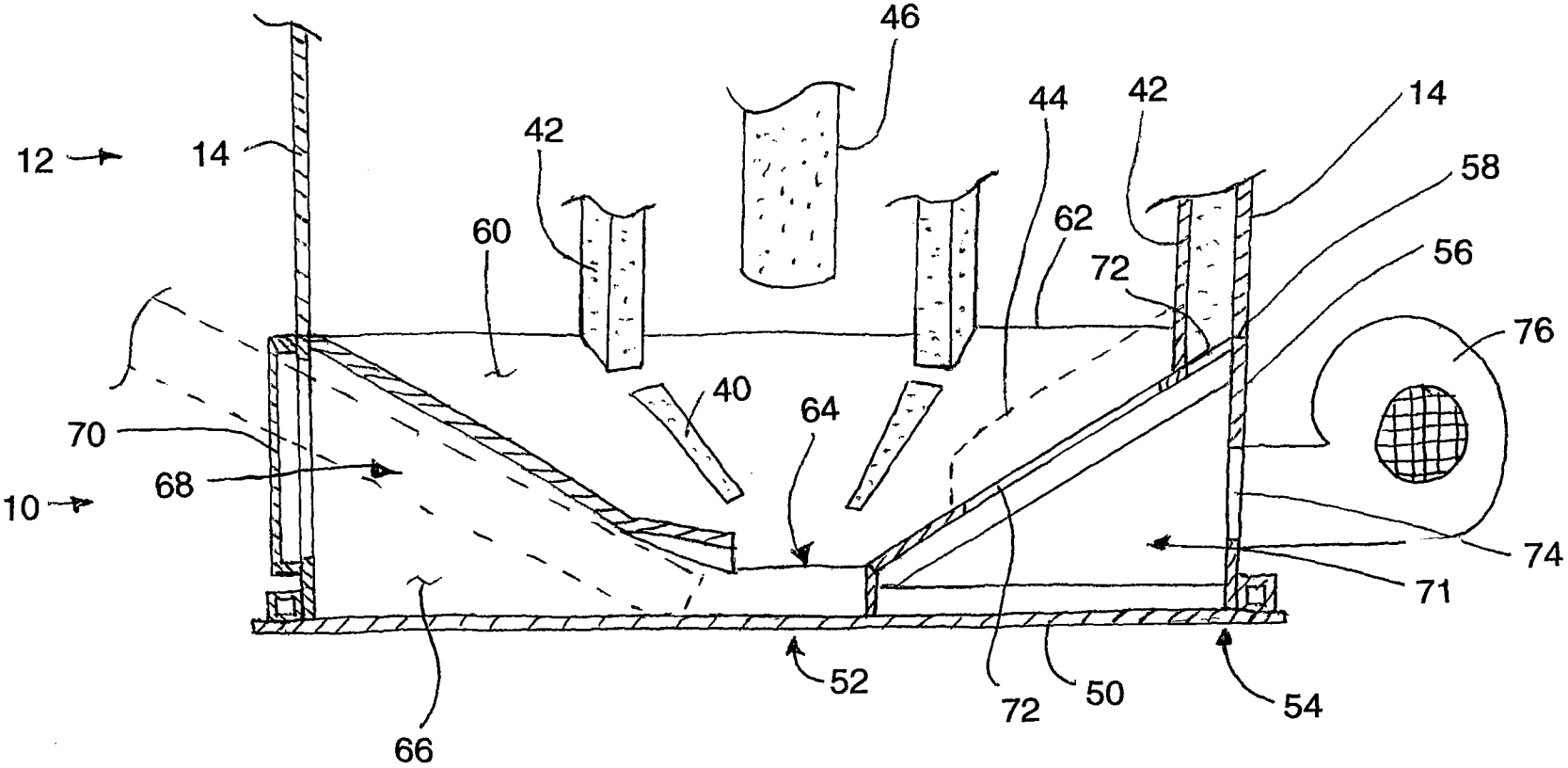
FIG. 3 is a sectional elevational view of a second embodiment of the grain bin hopper bottom.

Turning now to FIG. 3, according to a further embodiment of the hopper bottom 10, there is provided a floor structure 50 arranged to be supported on the ground or a suitable foundation. The floor structure comprises a continuous flat panel spanning radially outward from a central area 52 towards a perimeter area 54 surrounding the central area.

An outer cylindrical wall 56 extends upwardly about the full perimeter of the floor structure in a vertical orientation to a top edge 58 having a diameter corresponding approximately to the grain bin so as to be arranged to support the cylindrical side wall of the bin thereon.

The hopper bottom according to FIG. 3 further includes an inner hopper wall 60 extending at a downward and inward inclination from a peripheral edge 62 at the top end to a central opening 64 at the bottom end. The peripheral top edge 62 is joined to the cylindrical wall 56 adjacent the top end thereof such that the hopper wall is suspended from the top edge of the cylindrical wall to extend downwardly and inwardly to the central opening which is suspended above the central area of the floor structure.

The hopper wall is joined to the floor structure about part of the circumference of the central opening 64. The remaining portion of the hopper wall about the central opening is in sealed communication with two side walls 66 spanning radially between the central area and the perimeter of the floor and spanning a full height between the floor and the hopper wall. The side walls 66 define a discharge chute area 68 therebetween which extends radially from the central opening 64 to a discharge door 70 in the outer cylindrical wall 56 in alignment with the chute area. The two side walls 66 of the chute area are sealed with respect to the floor structure, the hopper wall and the outer cylindrical wall so as to define a manifold space enclosed between the hopper wall and the cylindrical wall about the remaining perimeter area not occupied by the chute 68.

A plurality of ventilation openings 72 are again provided in the hopper wall for communication between the manifold space 71 and the interior of the grain bin thereabove. The ventilation openings are provided at circumferentially spaced positions about the central area.

An inlet opening 74 is provided in the outer cylindrical wall 56 for communication with a blower 76. In this instance, air is directed from the blower into the defined manifold space for being subsequently directed upwardly through the respective ventilation openings and into the interior of the grain bin.

The ventilation openings are arranged to communicate with the interior of the grain bin by various means similar to those described with regard to the previous embodiment. Accordingly, in some instances a screen member 40 spans the ventilation opening flush with the interior hopper wall. Alternatively, an upright duct 62 extending into the grain bin upwardly along the side wall of the grain bin may again be used in communication with the ventilation opening to direct the ventilation air upwardly from the manifold space and into the grain bin at various elevations from the vertically oriented duct.

An inclined duct 44 as described above may also communicate with the ventilation opening. In yet further arrangements, the inclined duct may communicate with a larger ventilation opening spanning from the peripheral edge to the central opening with the inclined duct being in open communication with a respective upright duct to maximize the volume of air communicated from the manifold space upwardly into the ducts.

An exhaust duct 46 may also be employed similarly to the previous embodiment to maximize the exhausting of ventilation air from various elevations of the interior of the grain bin.

The arrangement of FIG. 3 thus permits air from a single blower 76 to be directed circumferentially through the manifold space below the hopper wall for being subsequently directed through ventilation openings in the hopper wall for communication with perforated ducts extending into the grain bin.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A hopper bottom for supporting a cylindrical side wall of a grain bin above a foundation, the hopper bottom comprising:

a hopper wall having an inverted cone shape so as to taper downwardly and inwardly from a peripheral edge at a top end of the hopper wall to a central opening at a bottom end of the hopper wall, the top end of the hopper wall being arranged to support the cylindrical side wall of the grain bin thereabove;

a plurality of upright support members each spanning between a bottom end of the upright support member arranged to be supported on the foundation and a top end of the upright support member supporting the hopper wall thereon so as to be arranged to support the hopper wall spaced above the foundation;

a plurality of ventilation openings communicating through the hopper wall in alignment with respective ones of the upright support members;

a hollow interior chamber within each upright support member in communication with a respective one of the ventilation openings in the hopper wall at a top end of the hollow interior chamber and communicating downwardly through each upright support member from the ventilation opening at the top end of the hollow interior to a bottom end of the hollow interior chamber;

a common manifold structure located externally of the hopper wall and being in communication with the hollow interior chamber of each upright support member i) at a location external of the hopper wall and ii) at a location along the hollow interior chamber which is spaced below the respective ventilation opening in the hopper wall such that the hollow interior chamber of each upright support member is in series between the common manifold structure and the respective ventilation opening in the hopper wall; and an inlet opening in the manifold structure arranged for communication with a blower so as to be arranged to direct ventilation air from the blower and into the grain bin through the manifold structure, through the hollow interior chambers of the upright support members collectively, and the ventilation openings in the hopper wall;

wherein the common manifold structure is solely connected to the hopper wall through the upright support members such that ventilation air directed into the inlet opening of the manifold structure from the blower is directed into the ventilation openings in the hopper wall solely through the hollow interior chambers of the upright support members.

2. The hopper bottom according to claim 1 wherein the support members comprise upright legs supported at circumferentially spaced locations about the peripheral edge of the hopper wall.

3. The hopper bottom according to claim 2 wherein each upright leg comprises a tubular member defining the respective hollow interior chamber therein.

4. The hopper bottom according to claim 1 wherein the manifold structure comprises a hollow tubular footing member extending in a circumferential direction below the peripheral edge of the hopper wall in connection with a bottom end of each upright support member such that the hollow interior of each upright support member communicates between the footing member and the respective ventilation opening in the hopper wall.

5. The hopper bottom according to claim 1 wherein there is provided a screen member spanning each of the ventilation openings in which the screen member is substantially flush with an upper surface of the inner wall.

6. The hopper bottom according to claim 1 further comprising a plurality of perforated ducts arranged to extend into the grain bin, the perforated ducts being in communication with the ventilation openings in the hopper wall respectively.

7. The hopper bottom according to claim 6 wherein the ventilation openings are located in the hopper wall in proximity to the peripheral edge at the top end of the hopper wall and wherein the plurality of perforated ducts are arranged to extend upwardly from the respective ventilation openings in the hopper wall alongside the cylindrical side wall of the grain bin.

8. The hopper bottom according to claim 6 wherein the ventilation openings are located in the hopper wall in proximity to the peripheral edge at the top end of the hopper wall and wherein the plurality of perforated ducts are arranged to extend downwardly and inwardly from the respective ventilation openings in the hopper wall along the hopper wall towards the central opening.

9. The hopper bottom according to claim 6 in combination with an upright perforated exhaust duct suspended centrally in the grain bin.

10. A hopper bottom for supporting a cylindrical side wall of a grain bin above a foundation, the hopper bottom comprising:

a hopper wall having an inverted cone shape so as to taper downwardly and inwardly from a peripheral edge at a top end of the hopper wall to a central opening at a bottom end of the hopper wall, the top end of the hopper wall being arranged to support the cylindrical side wall of the grain bin thereabove;

a footing member adapted to be supported on a foundation;

a plurality of upright support members each spanning between a bottom end of the upright support member supported on the footing member and a top end of the upright support member supporting the hopper wall thereon such that i) the hopper wall is supported on the footing member by the upright support members and ii) the central opening at the bottom end of the hopper wall is spaced above the footing member;

a plurality of ventilation openings communicating through the hopper wall in alignment with respective ones of the upright support members;

a hollow interior chamber within each upright support member in communication with a respective one of the ventilation openings in the hopper wall at a top end of the hollow interior chamber and communicating downwardly through each upright support member from the ventilation opening at the top end of the hollow interior to a bottom end of the hollow interior chamber;

a hollow manifold passage located within the footing member which is in communication with the bottom end of the hollow interior chamber of each upright support member such that the hollow interior chamber of each upright support member is in series between the hollow manifold passage in the footing member and the respective ventilation opening in the hopper wall; and an inlet opening in the footing member in communication with the hollow manifold passage, the inlet opening being arranged for communication with a blower so as to be arranged to direct ventilation air of the blower from the footing member to the ventilation openings in the hopper wall through the hollow interior chambers of the upright support members that are in series between the hollow manifold passage and the ventilation openings.

11. The hopper bottom according to claim 10 in combination with the grain bin supported above the hopper wall wherein the footing member is an annular member having a diameter which corresponding approximately to a diameter of the grain bin supported on the hopper wall.

12. The hopper bottom according to claim 10 in combination with the grain bin supported above the hopper wall wherein the footing member supports the hopper wall, the grain bin and the support legs on the foundation.

* * * * *